US005306198A

United States Patent [19]

Forman

[11] Patent Number: 5,306,198

[45] Date of Patent: Apr. 26, 1994

[54] TOY BUILDING BLOCK ASSEMBLY

[76] Inventor: Stanley Forman, 365 Geneva St., Apt. 307, St. Catharines, Ontario, Canada, L2N 5S7

[21] Appl. No.: 65,374

[22] Filed: May 24, 1993

[51] Int. Cl.[5] ..... A63H 33/06

[52] U.S. Cl. ..... 446/120; 446/116; 446/124

[58] Field of Search ..... 446/85, 116–122, 446/124, 98, 100

[56] References Cited

U.S. PATENT DOCUMENTS

| | | | |
|---|---|---|---|
| 3,689,075 | 9/1972 | Adelsohn | 446/85 |
| 4,003,144 | 1/1977 | Maddestra et al. | 446/122 |

FOREIGN PATENT DOCUMENTS

| | | | |
|---|---|---|---|
| 2568669 | 2/1986 | France | 446/124 |
| 506204 | 5/1939 | United Kingdom | 446/121 |

*Primary Examiner*—Robert A. Hafer
*Assistant Examiner*—Jeffrey D. Carlson
*Attorney, Agent, or Firm*—Leon Gilden

[57] ABSTRACT

The invention is arranged to include a plurality of various block-like members having configurations to include cubic, parallelepiped, and triangular cross-sectional configuration arranged for assemblage relative to one another, wherein each of the block members includes wall construction having a central opening directed therethrough, with each central opening including a surrounding annular flange recessed below each associated wall of each respective block member a predetermined thickness arranged to accommodate a resilient plug within an opening, having an annular flange equal to twice that predetermined thickness to permit securement of adjacent blocks together in a variety of shapes, as well as including replaceable panel plates, each including a panel plate ring having a ring thickness equal to the predetermined thickness received on the annular flange permitting altering of patterns, configurations, and theme upon associated blocks for use by children and the like.

3 Claims, 4 Drawing Sheets

TOY BUILDING BLOCK ASSEMBLY

BACKGROUND OF THE INVENTION

1. Field of the Invention

The field of invention relates to toy block construction, and more particularly pertains to a new and improved toy building block assembly wherein the same is arranged to provide for an associated panel mounting and block assemblage of adjacent blocks to secure blocks together in a variety of configurations.

2. Description of the Prior Art

Building blocks of various types are utilized throughout the prior art for association relative to one another for the sharpening of motor skills, as well as for the amusement and entertainment of children in a creative and constructive manner. To this end, U.S. Pat. Nos. 4,919,635; 4,895,544; 4,306,373; and 3,566,531 are examples of building block members arranged for assemblage.

The instant invention attempts to overcome deficiencies of the prior art by providing for a building block arrangement having blocks of various configurations arranged for assemblage relative to one another to selectively mount adjacent blocks utilizing connecting members or mounting cover plates relative to each of the blocks in use and in this respect, the present invention substantially fulfills this need.

SUMMARY OF THE INVENTION

In view of the foregoing disadvantages inherent in the known types of building block apparatus now present in the prior art, the present invention provides a toy building block assembly wherein the same is arranged to permit the securement of a plurality of blocks together in a selected manner in association with covering plates. As such, the general purpose of the present invention, which will be described subsequently in greater detail, is to provide a new and improved toy building block assembly which has all the advantages of the prior art building block apparatus and none of the disadvantages.

To attain this, the present invention provides the invention arranged to include a plurality of various block-like members having configurations to include cubic, parallelepiped, and triangular cross-sectional configuration arranged for assemblage relative to one another, wherein each of the block members includes wall construction having a central opening directed therethrough, with each central opening including a surrounding annular flange recessed below each associated wall of each respective block member a predetermined thickness arranged to accommodate a resilient plug within an opening, having an annular flange equal to twice that predetermined thickness to permit securement of adjacent blocks together in a variety of shapes, as well as including replaceable panel plates, each including a panel plate ring having a ring thickness equal to said predetermined thickness received on said annular flange permitting altering of patterns, configurations, and theme upon associated blocks for use by children and the like.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy building block assembly which has all the advantages of the prior art building block apparatus and none of the disadvantages.

It is another object of the present invention to provide a new and improved toy building block assembly which may be easily and efficiently manufactured and marketed.

It is a further object of the present invention to provide a new and improved toy building block assembly which is of a durable and reliable construction.

An even further object of the present invention is to provide a new and improved toy building block assembly which is susceptible of a low cost of manufacture with regard to both materials and labor, and which accordingly is then susceptible of low prices of sale to the consuming public, thereby making such toy building block assemblies economically available to the buying public.

Still yet another object of the present invention is to provide a new and improved toy building block assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
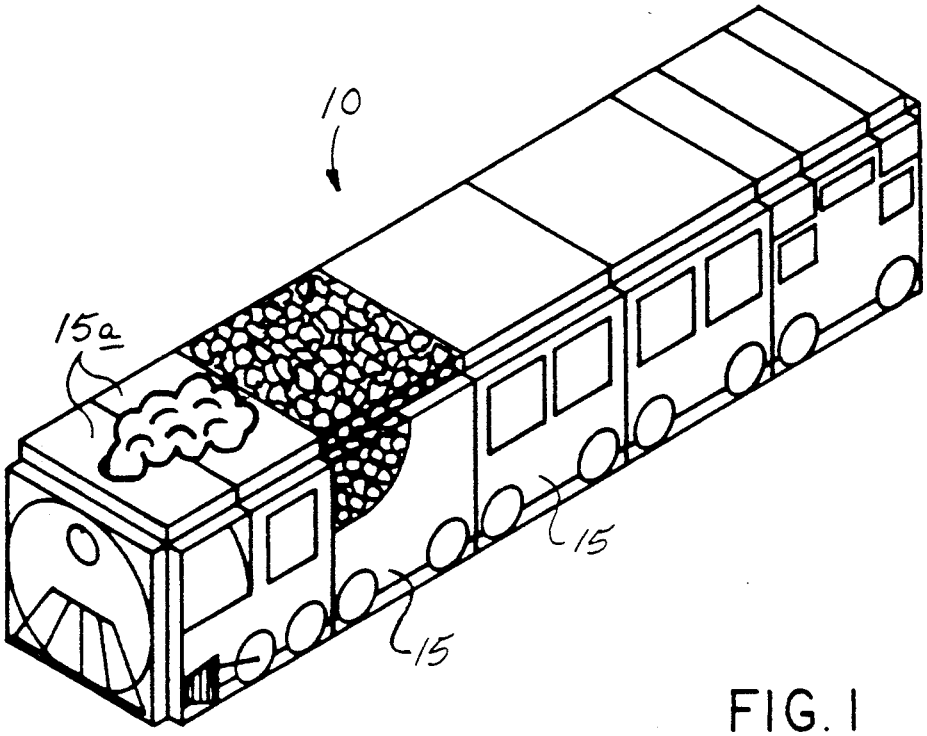
FIG. 1 is an isometric illustration of the invention employing a plurality of building blocks assembled together in association with covering plates.

With reference now to the drawings, and in particular to FIGS. 1 to 8 thereof, a new and improved toy building block assembly embodying the principles and concepts of the present invention and generally designated by the reference numeral 10 will be described.

Figure 2:
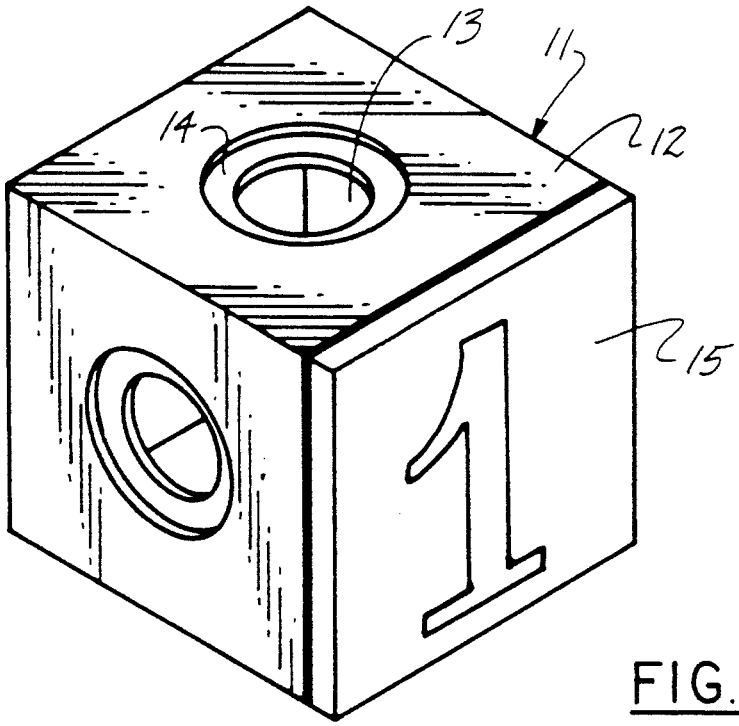
FIG. 2 is an isometric illustration of an individual block member having a covering plate mounted thereto.
Figure 3:
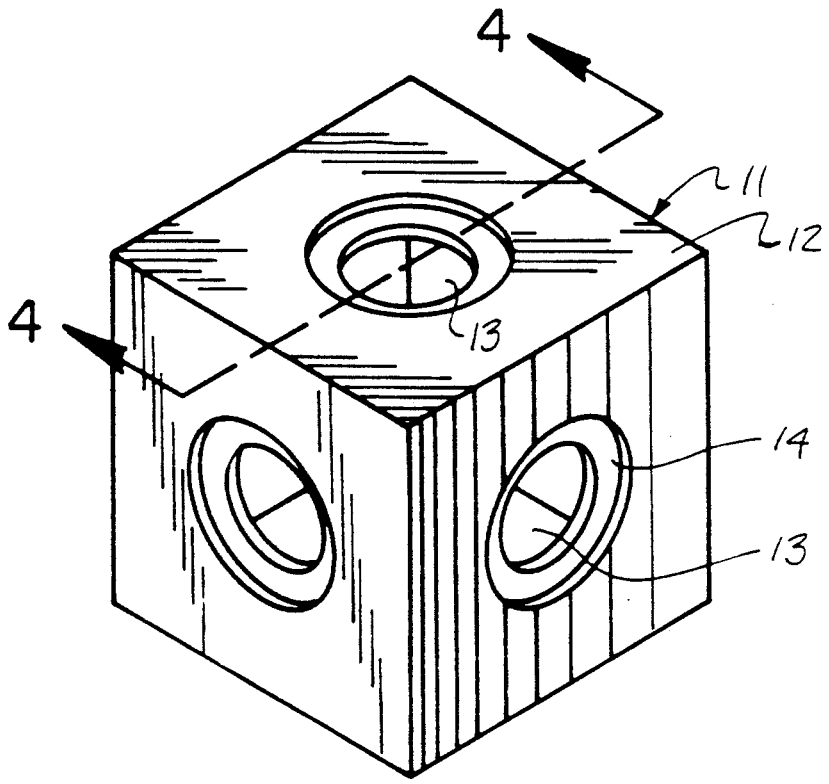
FIG. 3 is an isometric illustration of the building block.
Figure 4:
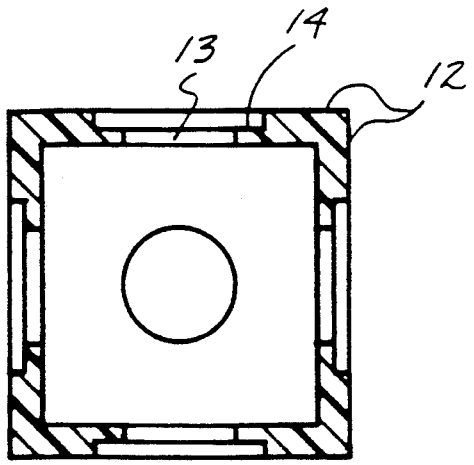
FIG. 4 is an orthographic view, taken along the lines 4—4 of FIG. 3 in the direction indicated by the arrows.
Figure 5:
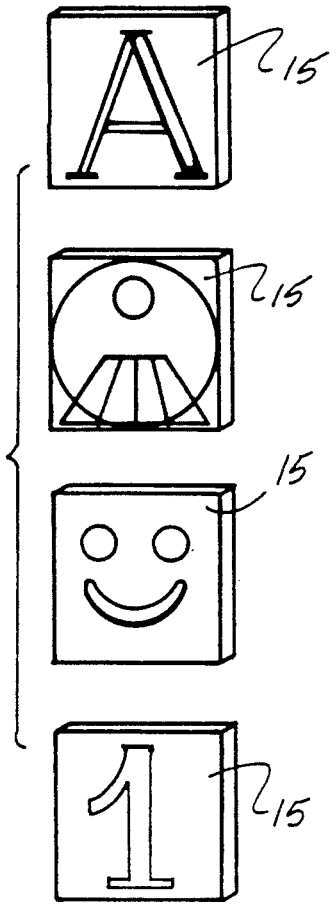
FIG. 5 is an isometric illustration of a plurality of covering plates indicating various covering themes.
Figure 5A:
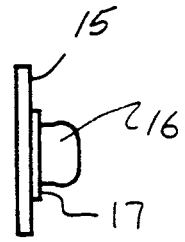
FIG. 5*a* is an orthographic side view of an individual covering plate member.
Figure 6:
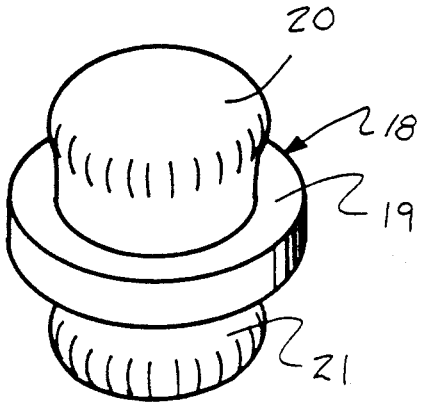
FIG. 6 is an isometric illustration of a connecting member employed by the organization.
Figure 7:
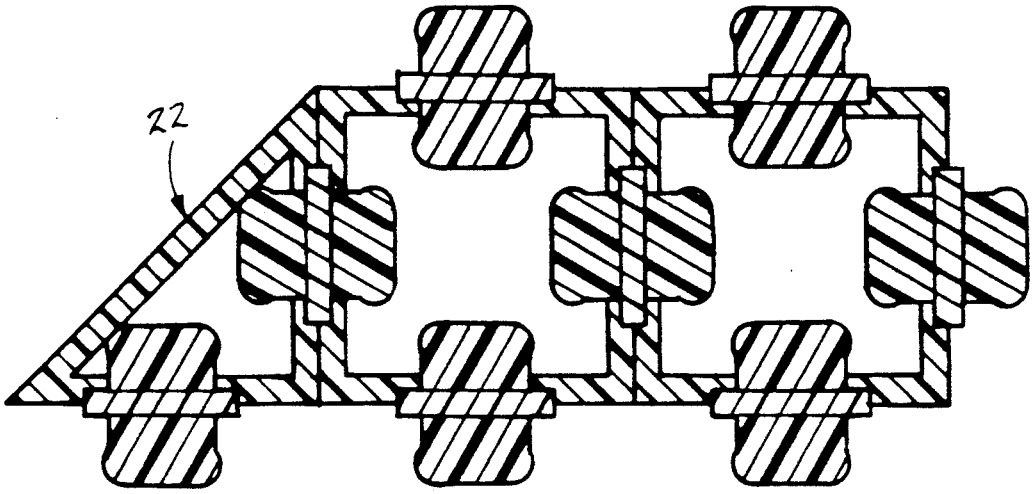
FIG. 7 is an isometric cross-sectional illustration of a plurality of building blocks mounted together in association with connecting members.

More specifically, the toy building block assembly 10 of the instant invention essentially comprises an assemblage of individual block members 11, of a type as indicated in the FIGS. 2–4 for example, indicated as having a hollow cube configuration, each having a plurality of planar block walls 12 of a predetermined configuration, and each of the walls 12 having a central wall annular opening 13 concentric relative to an annular surrounding flange 14 extending from the annular wall opening 13 to the block wall 12. To this end, in use of the organization, individual covering plates 15 of various themes such as trains and other vehicles, as well as the use of lettering and numerical themes, may be provided, wherein each of the covering plates 15 is of said predetermined configuration for complementary mounting relative to each of the walls 12. To this end, each covering plate rear wall surface includes a resilient projection 16 medially of the covering plate 15 and an annular ring 17 mounting the projection 16, wherein the surrounding flange 14 is recessed below the associated wall 12 of a predetermined thickness, and wherein the annular ring 17 is of said predetermined thickness for a flush contiguous mounting of the associated covering plate 15 relative to the associated wall 12, in a manner as indicated in FIGS. 1 and 2 for example. Further, a plurality of connecting members 18 are provided, each having a central rigid metallic disc 19 having a disc thickness equal to twice said predetermined thickness, including coaxially aligned first and second resilient connecting projections 20 and 21 projecting beyond both sides of the discs 19, with an associated connecting projection 20 arranged for reception within an associated annular opening 13 to permit the assemblage of a plurality of the block members 11, as well as connecting to a modified block member 22 of a triangular cross-sectional configuration, as indicated in the FIG. 7. The disc 19 having twice said predetermined thickness, as indicated in FIG. 7, provides for a contiguous and complementary mounting of the walls of adjacent block members.

Figure 8:
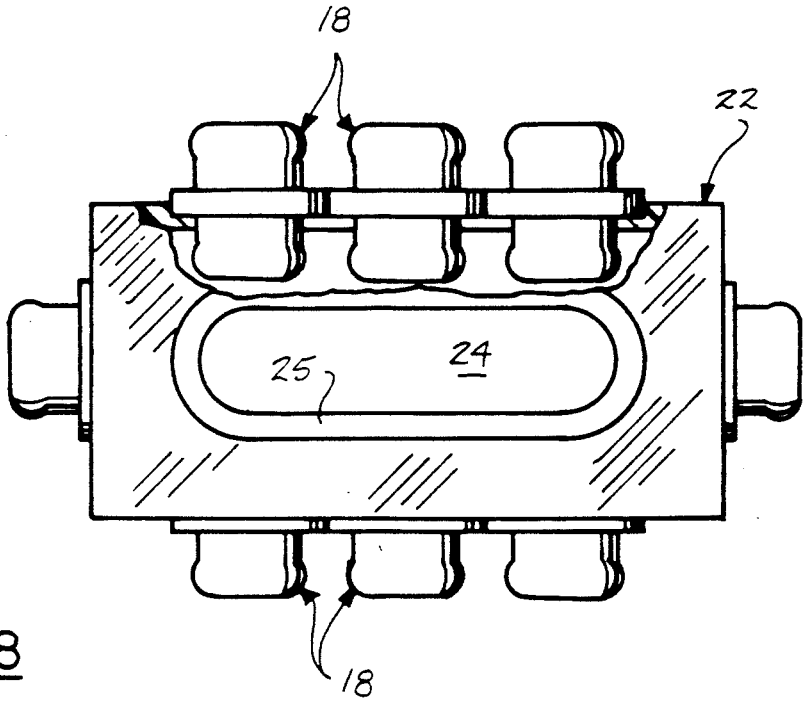
FIG. 8 is an orthographic view, partially in section, of the elongate modified building block member.

The FIG. 8 indicates a further example of a block member defined as a modified block member 22 of a generally parallelepiped configuration, wherein each of the walls is arranged to receive at least one of the connecting members 18. As illustrated, the elongate walls are provided with an elongate wall slot 24, having an elongate flange 25 recessed below the associated elongate wall said predetermined thickness to provide reception of a row of connecting members 18 permitting mounting of various plates such as the modified covering plates 15*a*, as indicated in FIG. 1, having a width equal to half the predetermined width of an associated wall 12 permitting various components to partially cover an associated elongate wall of the modified block member 22.

In this manner, various block members may be configured in any desired orientation subject to the imagination of a child and the like to thereby promote the creative utilization of such block members, as well as the enhancing of motor skills of children and the like in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A toy building block assembly, comprising, a plurality of block members, wherein at least one of said block members includes a hollow cubicle configuration having planar block walls, wherein each of said block walls is formed of a predetermined configuration, and each of the block walls includes a central wall annular opening, and said central wall annular opening including an annular surrounding flange recessed below said planar block wall a predetermined thickness, and at least one covering plate arranged for mounting to said planar block wall, and the covering plate having a plate configuration equal to said predetermined configuration, said covering plate including a front wall having a predetermined configurational theme imparted thereon, and the covering plate having a plate rear wall having a rigid annular ring, including a resilient projection, with the annular ring and the resilient projection concentrically mounted relative to the rear wall and medially of the rear wall, and the resilient projection arranged for reception within the central wall annular opening, and the annular ring having a ring thickness equal to said predetermined thickness arranged for complementary mounting onto said annular surrounding flange.

2. A toy building block assembly as set forth in claim 1 including at least one connecting member, the connecting member including a rigid central cylindrical disc, having a disc thickness equal to said twice the predetermined thickness to secure a plurality of said block members together, wherein said connecting member further includes first and second resilient connecting projections concentrically mounted relative to said central cylindrical disc in a coaxially aligned relationship mounted on opposed sides of said central cylindrical disc.

3. A toy building block assembly as set forth in claim 2 wherein said block members include a modified block member having a parallelepiped configuration, including an elongate wall, wherein said elongate wall includes an elongate wall slot arranged to receive a plurality of said connecting members, and wherein said elongate wall slot includes an elongate flange in surrounding relationship relative to the elongate wall slot, and said elongate flange is recessed below said elongate wall said predetermined thickness.

* * * * *